US007473286B2

(12) United States Patent
Blaschke et al.

(10) Patent No.: US 7,473,286 B2
(45) Date of Patent: Jan. 6, 2009

(54) CO GENERATOR

(75) Inventors: Herbert Blaschke, Moers (DE); Werner Breuer, Krefeld (DE); Karl-Heinz Köhler, Viersen (DE); Herbert Ungerechts, Kerken (DE)

(73) Assignee: Bayer MaterialScience AG (DE)

( * ) Notice: Subject to any disclaimer, the term of this patent is extended or adjusted under 35 U.S.C. 154(b) by 672 days.

(21) Appl. No.: 10/964,381

(22) Filed: Oct. 13, 2004

(65) Prior Publication Data

US 2005/0100496 A1 May 12, 2005

(30) Foreign Application Priority Data

Oct. 16, 2003 (DE) ..... 103 48 116

(51) Int. Cl.

| | |
|---|---|
| ***B01J 7/00*** | (2006.01) |
| ***B01J 8/18*** | (2006.01) |
| ***H01M 8/06*** | (2006.01) |
| ***F27B 15/00*** | (2006.01) |
| ***F27B 15/14*** | (2006.01) |
| ***F27B 15/16*** | (2006.01) |
| ***B05B 1/04*** | (2006.01) |

(52) U.S. Cl. ..... 48/61; 422/139; 422/146; 239/592; 239/594

(58) Field of Classification Search ..... 48/197 R; 239/589, 592, 594, 595, 597, 598, 599, 601
See application file for complete search history.

(56) References Cited

U.S. PATENT DOCUMENTS 3,011,965 A * 12/1961 Decker ..... 208/64
3,635,672 A 1/1972 Johnson ..... 23/204 M (Continued)

FOREIGN PATENT DOCUMENTS

DE 34 26 912 1/1986

(Continued)

OTHER PUBLICATIONS

Lueger, Lexikon der Technik, vol. 16, Verfahrenstechnik (month unavailable) 1970, pp. 423-424, Sauggeschwindigkeit—Schachtofen.

(Continued)

*Primary Examiner*—Alexa D Neckel
*Assistant Examiner*—Matthew J Merkling
(74) *Attorney, Agent, or Firm*—Connolly Bove Lodge & Hutz LLP

(57) ABSTRACT

A generator including a double-chamber lock comprising two tapered or vertical chambers lined with ceramics or plastics, as a charging device, at least one tubular shaft furnace comprising a water-cooled double jacket of steel, a double-walled, water-cooled inlet nozzle of copper for a gasification mixture, arranged centrally in the tubular shaft furnace above the base, a dry dust-removing device, and optionally a desulfurising device. The double-chamber lock has a mechanism which causes one of the chambers to open when the lower chamber of the double-chamber lock is flushed with inert gas after charging/opening operations, and the inlet nozzle constitutes the mixing member for the constituents of the gasification mixture, the inlet nozzle has a radius of curvature of the surface of the cylindrical portion of the nozzle which continuously becomes smaller to the outlet opening, and the direction of flow of the gases leaving the inlet nozzle is directed upwards.

17 Claims, 2 Drawing Sheets

U.S. PATENT DOCUMENTS

| | | | | | |
|---|---|---|---|---|---|
| 3,758,673 | A | | 9/1973 | Buben et al. | 423/415 |
| 3,801,288 | A | | 4/1974 | Leas et al. | 23/288 R |
| 4,007,015 | A | | 2/1977 | Barber | 23/281 |
| 4,146,369 | A | * | 3/1979 | Flesch et al. | 48/201 |
| 4,180,387 | A | | 12/1979 | Rudolph | 48/206 |
| 4,453,950 | A | * | 6/1984 | Fasching | 48/86 R |
| 4,564,513 | A | | 1/1986 | Becher et al. | 423/415 |
| 4,734,110 | A | * | 3/1988 | Premel et al. | 95/268 |
| 4,744,958 | A | * | 5/1988 | Pircon | 422/193 |
| 2004/0141901 | A1 | | 7/2004 | Breuer et al. | 423/244.09 |

FOREIGN PATENT DOCUMENTS

| | | |
|---|---|---|
| GB | 1098552 | 1/1968 |
| GB | 1 453 787 | 10/1976 |
| GB | 1 512 677 | 6/1978 |
| NL | 8303992 | 6/1985 |

OTHER PUBLICATIONS

Lueger, Lexikon der Technik, vol. 5, Hüttentechnik, (month unavailable) 1970, pp. 540-541, Schachtarbeit-Hochofen—Schachtöfen zum Brennen.

* cited by examiner

CO GENERATOR

CROSS REFERENCE TO RELATED PATENT APPLICATION

The present patent application claims the right of priority under 35 U.S.C. §119 (a)-(d) of German Patent Application No. 103 48 116.8, filed Oct. 16, 2003.

BACKGROUND OF THE INVENTION

1. Field of the Invention

The present invention relates to a novel generator for the reaction of carbon-containing raw materials and also to an improved process for the production of carbon monoxide gas (CO gas) having a high degree of purity using such a generator.

2. Description of the Prior Art

Carbon monoxide gas is frequently produced in the art by means of a continuous process in which carbon-containing raw materials are reacted with oxygen and carbon dioxide at relatively high temperatures using the Boudouard equilibrium.

The principle of a vertical shaft furnace for such thermal processes has been known for a long time from metallurgy and is described, for example, in "Lueger, Lexikon der Technik, Vol. 16 (1970), Verfahrenstechnik and in Vol. 5 (1970), Hüttentechnik". However, it does not meet the demands of an efficient continuous CO gas production installation in many respects.

Accordingly, attempts have repeatedly been made in the past to improve the gasification of coal in various respects.

U.S. Pat. No. 3,635,672, as the closest prior art, describes a coal gasification process in a vertical reactor containing separating plates which are permeable to gas and solids and which separate the reaction chamber into solids regions and gas chambers.

$CO_2$ gas and CO gas are introduced into the fluidised coke bed from beneath and $O_2$ is introduced into the gas chambers from the side in order, by the combustion of CO to $CO_2$, to generate the necessary heat energy required for the endothermic reaction of $CO_2$ with C to form CO in the fixed bed.

This process has the disadvantage that the elements built into the reactor are very complex and make high demands of the flowability of the solid material in order to avoid blockages and hence impairment of the combustion process. In addition, they represent a cost factor in the construction and maintenance of the installation and reduce the space-time yield of the reactor to a not inconsiderable degree.

DE 34 26 912 describes a specific shaft furnace as the reactor and a process for the gasification of coke. In this specification, a CO gas having a purity of more than 90 vol. % is produced from coke using oxygen and carbon dioxide. Charging with coke takes place at the upper end of the shaft, where the CO gas produced is also discharged counter-currently. A combustion nozzle is arranged horizontally at the base of the shaft furnace at the slag outlet opening and conveys the combustion gases to the coke bed, the CO gas produced being mixed, as fuel, with oxygen and carbon dioxide before it enters the nozzle. In this manner, a flame forms at the nozzle, which should ensure that the slag flows away unhindered.

A disadvantage of this process is the formation of a flame at the burner and its predominantly horizontal orientation beneath the coke bed, with the result that only inadequate control of the coal gasification process is possible. This manifests itself, for example, in the CO gas purity that is achieved of only 92.5 vol. % and a proportion of 3.0 vol. % for each of hydrogen and carbon dioxide. A further disadvantage of this process is the addition of flux agents and the discharge of combustion residues in the form of liquid slag.

EP 142 097 describes a similar variant of such a CO gas generator, the nozzle for the gasification agents $O_2$ and $CO_2$ passing laterally through the jacket of the tubular shaft furnace and pointing downwards, thus facilitating the discharge of slag.

As our own tests have shown, such nozzle arrangements have the disadvantage that the combustion zone created inside the furnace is asymmetrical, which leads to overheating of the opposing side of the jacket of the tubular shaft furnace and which must be avoided at all costs in the case of steel jackets without additional heat-insulating lining.

GB 1 453 787 describes the gasification of coal in a shaft furnace which is likewise charged with coke from above, $CO_2$ being injected from beneath and $O_2$ being injected laterally through porous bricks, so that the combustion zone is created in the middle of the shaft furnace and the CO gas escapes at the top.

A disadvantage of this process is that the capacity of the shaft furnace is utilised wholly inadequately because coke that has not been burnt is removed at the base of the furnace and fed back into the system from the top, until the ash content has reached a critical limit. The patent contains no information regarding the purity of the CO gas.

U.S. Pat. No. 4,007,015 describes the production of CO gas in a two-chamber furnace having a heat exchanger, CO being obtained in a subsidiary process in addition to the $CO_2$ production. The CO is obtained without supplying oxygen to provide additional energy for the reaction of $CO_2$ with carbon, the $CO_2$ gas entering the CO-producing chamber filled with coke being heated solely by a common heat exchanger.

This process has the disadvantage that possibilities for controlling the process in order to produce a qualitatively highly pure CO gas are insufficient.

NL 8 303 992 is to be regarded as more remote prior art, in which there is described a vertical shaft furnace with fire-resistant wall lining, in which carbon dust is burnt in a turbulent air stream, with the creation of a so-called "raceway" in which the gasification of coal takes place.

Other processes work with the aid of catalysts such as, for example, $Cs_2CO_3$ (U.S. Pat. No. 3,758,673) or cobalt oxide (U.S. Pat. No. 3,801,288).

There has also been no lack of attempts to improve the difficult process of discharging residues, predominantly in the form of liquid slag, from the shaft furnace during the gasification of coal. Examples thereof are given in patent specifications GB 1 098 552, GB 1 512 677 and DE 27 38 932. The major disadvantage of these processes is that the combustion residues do not occur in finely divided solid form which could be discharged with the flue dust, but must be discharged in the form of liquid slag, which is difficult to handle.

All these cited examples of the prior art exhibit deficiencies which are troublesome for a modern production operation from the point of view of environmental protection, operating safety and economic efficiency.

An object of the present invention was, therefore, to develop a novel shaft furnace (referred to as a generator hereinbelow) which creates and maintains a stable combustion zone during the whole of the operating time of the furnace and which accordingly ensures a uniform combustion process. Such a uniform combustion process is an important requirement for the observance of high purity criteria for the CO gas that is obtained. Furthermore, CO emissions are to be avoided, especially during the operation of charging the tubular shaft furnace. A further object of the invention was to remove sufficient dust (more than 95%, preferably more than 99%) from the CO gas that has been produced, before any subsequent working-up steps, such as, for example, catalytic desulfurisation, and to dispose of the solid flue ash fractions in an environmentally suitable manner.

A further object of the invention was to provide a continuous process for the production of CO gas by the gasification of coal using the generator according to the invention, which process does not exhibit the disadvantages described above. This means in particular avoiding the formation of liquid slag and the discharge thereof from the apparatus.

A further object of the invention was to produce a CO gas having a purity of greater than 96 vol. %, preferably from 97 to 98 vol. %. The CO gas should in particular contain not more than 1.5 vol. % hydrogen (preferably <1.2 vol. %, particularly preferably <0.7 vol. %), not more than 0.15 vol. % oxygen (preferably <0.10 vol. %, particularly preferably <0.08 vol. %) and not more than 50 ppm methane (preferably <35 ppm, particularly preferably <25 ppm). Depending on the residual sulfur content in the carbon raw material employed, which is dependent on the origin of the raw material, the CO gas produced therefrom also contains further amounts of up to 7000 mg/Nm$^3$ (preferably <5000 mg/Nm$^3$, particularly preferably <3000 mg/Nm$^3$) of organic sulfur compounds and up to 500 mg/Nm$^3$ of inorganic sulfur compounds (preferably <300 mg/Nm$^3$, particularly preferably <200 mg/Nm$^3$).

In this text, the term Nm$^3$ is understood as meaning 1 m$^3$ of a gas (e.g. CO, $O_2$) at a temperature of 20° C. and a pressure of 1.01325 bar.

SUMMARY OF THE INVENTION

The present invention is directed to a generator that includes (I) a double-chamber lock containing two tapered or vertical chambers lined with ceramics or plastics, as a charging device, (II) at least one tubular shaft furnace containing a water-cooled double jacket of steel, (III) a double-walled, water-cooled inlet nozzle of pure copper for a gasification mixture, arranged centrally in the tubular shaft furnace just above the base, (IV) a dry dust-removing device, and also (V) optionally a desulfurising device, where the double-chamber lock (I) has a mechanism which has the effect that one of the chambers is open when the lower chamber of the double-chamber lock (I) is flushed with inert gas after each charging operation and opening operation, and the inlet nozzle (III) at the same time constitutes the mixing member for the constituents of the gasification mixture, the inlet nozzle is characterised by a radius of curvature of the surface of the cylindrical portion of the nozzle which continuously becomes smaller to the outlet opening, and the direction of flow of the gases leaving the inlet nozzle is directed vertically upwards.

The present invention also provides a process for the production of carbon-monoxide-containing gas including reacting a carbon-containing combustion material in the above-described generator, where the carbon-containing combustion material has a particle diameter of from 20 to 90 mm, a carbon content of at least 85 wt. %, an ash content of not more than 5 wt. %, a content of water adhering to the surface of less than 10 wt. % and an iron content of not more than 5000 ppm.

DETAILED DESCRIPTION OF THE INVENTION

Figure 1:
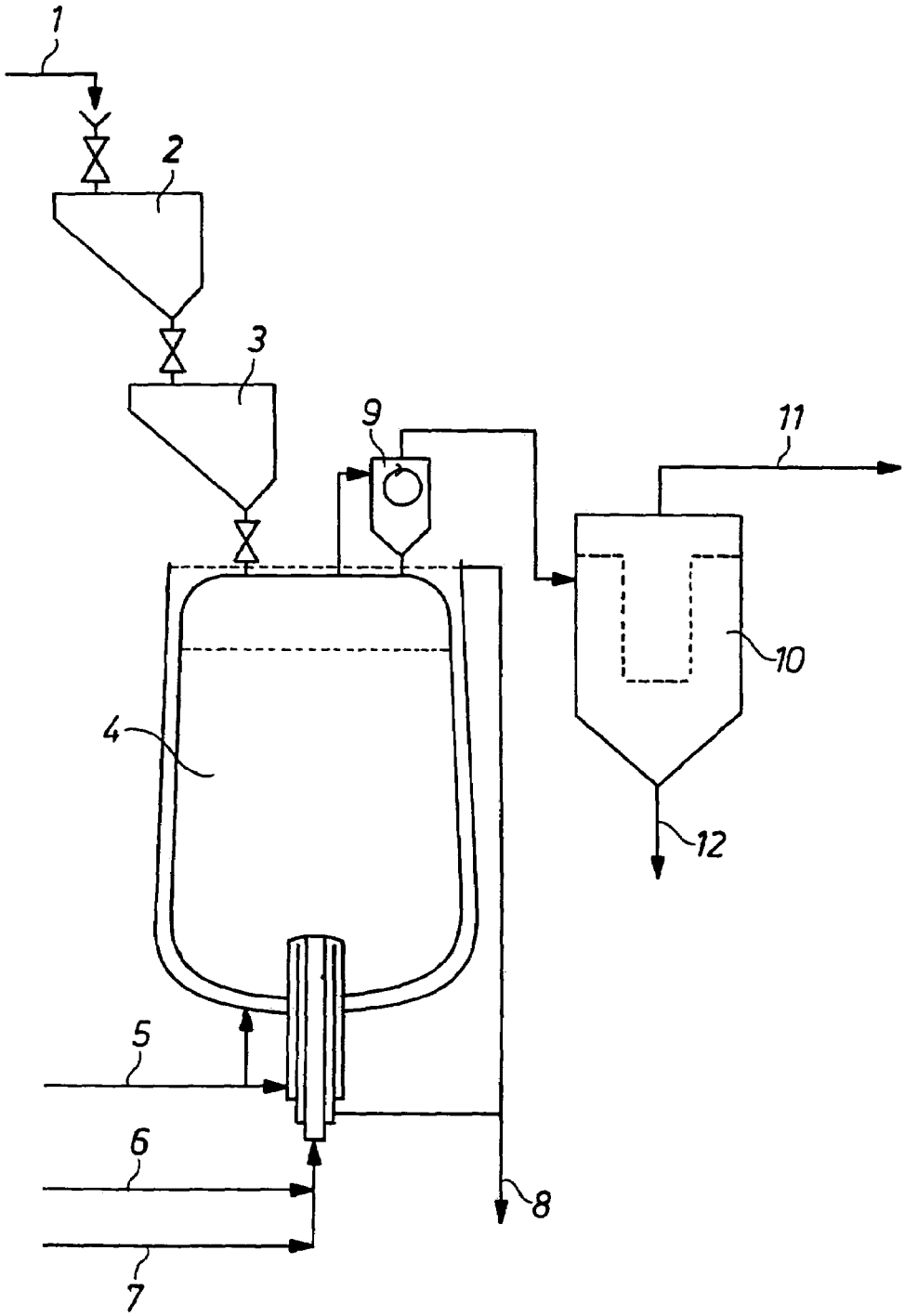
FIG. 1 shows a schematic diagram of a generator according to the invention.

Other than in the operating examples, or where otherwise indicated, all numbers or expressions referring to quantities of ingredients, reaction conditions, etc. used in the specification and claims are to be understood as modified in all instances by the term "about." It has now been found, surprisingly, that the above-described objects can be achieved by the generator described in the following and the process described hereinbelow.

The present invention provides a generator comprising (I) a double-chamber lock consisting of two tapered or vertical chambers lined with ceramics or plastics, as the charging device, (II) at least one tubular shaft furnace consisting of a water-cooled double jacket of steel, (III) a double-walled, water-cooled inlet nozzle of pure copper for the gasification mixture, arranged centrally in the tubular shaft furnace just above the base, (IV) a dust-removing device, and also (V) optionally a desulfurising device, wherein the double-chamber lock has a mechanism which has the effect that only ever one of the chambers is open and the lower chamber of the double-chamber lock is flushed with inert gas after each charging operation and opening operation, and the inlet nozzle at the same time constitutes the mixing member for the constituents of the gas mixture, and the direction of flow of the gases leaving the inlet nozzle is directed vertically upwards.

The technology of the generator according to the invention has advantages over other technologies, such as, for example, fluidised-bed furnaces, which are based essentially on the fact that the CO gas that forms escapes upwards through the fixed bed counter-currently to the direction of flow of the fixed bed and is drawn off from the furnace at the upper end. The height of the fixed bed can be adjusted to ensure that the combustion zone is adequately covered with the granular combustion material. In this manner, water adhering to the combustion material, up to specific maximum contents, can be vaporised by the rising hot CO gas and kept away from the combustion zone, so that no reaction of water with carbon can take place therein to form hydrogen in an unacceptably large amount. This is an important requirement for the observance of the desired CO gas purity in respect of hydrogen.

The geometry and size of the tubular shaft furnace (II) can be varied within relatively wide limits. A preferred embodiment according to the invention is a cylinder which widens conically to the bottom and has a diameter of 800 mm at the top and 1000 mm at the bottom, with a height of 2300 mm. The productive capacity is 600 Nm$^3$/h of CO gas at gas temperatures of 250° C. to 600° C. to a maximum of 850° C. and an excess pressure of 50 mbar. A further preferred embodiment is a cylindrical container having a diameter of 2000 mm and a height of 5000 mm. The productive capacity is 1400 kg (1120 Nm$^3$/h) of CO gas at 350° C. to 700° C. and a maximum of 850° C. at an excess pressure not exceeding 6 bar, preferably 3 bar. The walls of the tubular shaft furnaces consist of a double jacket of steel (H-II steel), which is cooled by means of water in order to protect against overheating.

A plurality of such tubular shaft furnaces can be connected with one another in parallel operation to form a production unit, it being possible for each tubular shaft furnace to be separated from the other tubular shaft furnaces by means of suitable shut-off valves in the piping system, so that there is no risk of gases flowing back into tubular shaft furnaces which have been taken out of operation.

The correct formation of the combustion zone (plasma zone) in the fixed bed, which consists of the fuel, is inextricably linked with the proper covering of the combustion chamber by the fixed bed. If this is not ensured, it is possible that, with too small an amount of fuel above the combustion chamber, this combustion zone will collapse into the hollow space (the so-called combustion chamber) located beneath it. The combustion gases would then pass through the combustion zone and cause considerable safety problems in terms of the inflammability of the gas and overheating of the furnace, in addition to an impairment of the quality of the CO gas. In order to avoid this, it must be ensured that the combustion chamber is always adequately covered with fuel during the whole of the operating time of the furnace.

This means that, as the fuel is burnt away in the combustion zone, an approximately equal amount of fresh fuel must be fed into the tubular shaft furnace from above, continuously or in portions. The time intervals at which this takes place are not unimportant because, if the interval between successive additions of fuel is too long, the height of the fixed bed above the combustion zone might fall below a critical height, resulting in the above-mentioned problems. In order to avoid this, it is necessary to match the frequency of addition of fuel to the production amount.

When making such additions of fuel it is necessary to ensure that the tubular shaft furnace system, which is in itself closed, is opened at the time of the addition and an exchange of gas with the surroundings can take place. This means on the one hand contamination of the CO gas from the furnace drawn off above the fixed bed by incoming oxygen and nitrogen, and on the other hand contamination of the air surrounding the furnace with CO. Both occurrences are strictly to be avoided for reasons of environmental protection and quality assurance and, optionally, the safety of the installation.

In the generator according to the invention, such contamination is avoided by the construction of a so-called double-chamber lock (I). A mutual locking mechanism for the opening devices of the two lock chambers has the effect that only ever one of the two chambers is open, while the other chamber remains closed. As a result it is ensured that, during the whole of the operation of charging a tubular shaft furnace, the tubular shaft furnace is not open to the outside at any time. The lower of the two lock chambers, which is connected directly with the tubular shaft furnace and is filled with CO gas by volume exchange during the opening procedure, in which bulk material passes into the tubular shaft furnace, is largely freed of the CO gas that has flowed in by flushing with inert gas, such as, for example, with nitrogen or $CO_2$, after emptying and closing. During the subsequent charging operation with bulk material from the second lock chamber located above it, the inert gas used for flushing passes out of the lower lock chamber into the upper lock chamber as a result of volume exchange with the bulk material. No further flushing is required in the upper lock chamber because, on the next operation of charging the upper chamber, nitrogen, for example, escapes into the surroundings as an inert gas, which is a normal constituent of the air. However, after the operation of charging the lower (flushed) lock chamber nozzle, the latter is further flushed with inert gas in order to remove the oxygen carried in with the bulk material. In the generator according to the invention, this process sequence is controlled by an automatic sequence control. By means of methods known per se for detecting the end point of the particular position of opening devices on the lock chambers, it is ensured that the desired mutual locking function of the opening devices of the two lock chambers is actually ensured. In the event that one opening device does not reach the end point position, the further programme sequence is interrupted and the temporary secure position of the opening devices is retained.

For reliable operation and an adequate sealing function of the opening devices on the lock chambers, the structural materials and the sealing materials must meet high demands, because they are exposed to high temperatures, abrasive materials and moisture. In a preferred embodiment, the walls of the lock chambers are lined on the inside, which comes into contact with the product, with a special ceramics (e.g. 20 mm oxide ceramics, commercial name: "Kalocer"), which in turn is bonded to the metal substrate by means of a special cement (e.g. commercial name: "Kalfix"). Various types of valve are suitable as opening devices, such as, for example, slide valves, conical valves or ball valves or stop-cocks from Strack or Tyko in the form of ventable stop-cocks or Strack slide valves. They are manufactured from high-temperature steels on the side facing the furnace or of ceramics and possess sealing elements of ductile metals, such as, preferably, stellite, for the seats and PTFE for the strippers that remove coke dust from the sealing surfaces.

Because the abrasive effect of coke dust on any kind of sealing elements is unavoidable, special structural measures have been developed in the case of slide valves as the opening device in order to protect the sealing elements from the deposition of coke dust during the operation of adding coke. When the valves open, the sealing surfaces are raised from the seals and the valves can be opened without contact with the sealing elements. For closing, strippers clean the sealing surfaces and the sealing surface is pressed into the seal when the end positions have been reached.

The double-chamber lock system for charging of the furnace is distinguished by a characteristic construction. The individual locks are tapered containers lined with ceramics, having an angle of inclination of more than 35°, preferably 40°, with a diameter of about 1200 mm. The lock volume is about 920 litres. Valves which are preferably used are pneumatically operated sealing cones which close towards the furnace. The sealing cone is lined towards the furnace with a thermal shield of high-temperature steel. Alternatively, sealing can be effected using ball valves from Tyko with stellite-coated seals or Strack slide valves with a sintered metal seal as heat protection. Preferred sealing materials are metal sealing elements for the sealing cones of high-temperature steel, and sintered metal and stellite seals for the valves.

By means of the above-described double-chamber lock system and the associated process sequence control, it is possible to feed the fuel into the tubular shaft furnace with a frequency of addition that is matched to the production amount and while maintaining all safety aspects. The addition of fuel into the tubular shaft furnace by means of this system is triggered by a level-measuring device which detects the height of the fixed bed in the tubular shaft furnace and, if the height is below a critical mark, triggers an electrical signal which sets the addition process in motion. Under the indicated physical conditions in such a tubular shaft furnace, a radiometric level-measuring device attached to the outside wall is highly suitable for detecting levels.

Charging of the double-chamber lock system with the fuel is likewise preferably carried out fully automatically by means of a suitable charging device with the aid of a process sequence control which receives its demand signal from the signal that the uppermost lock chamber is empty. The charging device may be, for example, a conventional charging vessel connected to a transport device and a distance pick-up which, on demand, positions the vessel, for emptying, precisely in front of the funnel of the upper double-chamber lock that is to be charged. Better suited for larger amounts are conveyor belts of rubberised fabric of a suitable length, which belts are able to feed in both directions and produce a direct connection between the outlet funnel of the storage bunker and the charging funnel of a double-chamber lock. The precise positioning of the discharging end of the conveyor belt at the charging funnel is likewise ensured by a suitable device, for example a track vehicle in combination with a distance pick-up.

It is also possible for both systems to be used as redundancy. Between the outlet of the storage bunker and the charging device there is usually a screen which sieves the fine portions from the fuel before the charging operation; suitable screens are, for example, so-called resonance-vibrating screens with perforated-plate inserts having openings of variable size.

The formation of a stable combustion zone is best achieved according to the invention when the inlet nozzle (III) for injecting the gasification agents ($CO_2$ and $O_2$) into the tubular shaft furnace (II) is arranged centrally in the furnace just above the base, the direction of flow of the emergent gases being directed vertically upwards. In this manner there is formed above the inlet nozzle after a certain time following starting of the tubular shaft furnace, and while maintaining further process conditions, a stable hollow chamber as the combustion chamber within the fixed bed, which chamber is comparable with the so-called "raceway" of NL 8 303 992.

Within this combustion chamber, the reaction of the gasification agents with the carbon takes place at the boundary with the solid phase, the so-called combustion zone or plasma zone. Any other nozzle arrangements and directions of flow do not lead to this optimum result. In contrast to other procedures known from the prior art, no flame is formed at the inlet nozzle, because the combustion gases that are introduced do not contain CO.

A further important requirement for the formation of a stable combustion zone is the construction of the inlet nozzle (III). This nozzle is distinguished by the following characteristic features:

- it is manufactured from pure OF copper in order to avoid corrosion and to increase its heat resistance (OF copper is oxygen-free copper)
- the nozzle is of double-walled construction and its temperature is controlled during operation by means of a water-cooling circuit
- the nozzle is at the same time the mixing member for the gases $CO_2$ and $O_2$, which are introduced into the furnace together in the form of a mixture.

It is possible with the aid of such an inlet nozzle to form a stable combustion zone in the furnace and to ensure uniform burning of the fuel, if the nozzle is arranged as described above.

By adapting the dimensions of the nozzle channel to the production capacity of the furnace and to the particle size of the fuel, a sufficiently high delivery speed of the gas jet from the nozzle and a form of the gas jet that is matched to the fuel are ensured. As a result it is possible, for example, to prevent fuel particles falling onto the nozzle from the plasma zone from deflecting the gas jet to the side and hence preventing the formation of the desired combustion zone and optionally effecting burning through of the nozzle.

The nozzle outlet channel has a characteristic widening and a characteristic diameter. These parameters are governed by the particle size of the combustion material and by the throughput of gases through the nozzle.

Nozzles which are suitable according to the invention are, for example, the following forms: jacket-cooled copper nozzles having a nozzle inside diameter of from 18 mm to 32 mm for fuels having particle sizes of from 20 mm to 60 mm or for production amounts of CO gas/h of from 100 to 1400 $Nm^3$.

Preferred forms are nozzles having an inside diameter of 18 mm (measured in the cylindrical upper portion of the nozzle) for particle sizes from 20 mm to 60 mm in furnaces having an inside diameter of 800 mm, and also for particle sizes from 10 mm to 40 mm in furnaces having an inside diameter of up to 2000 mm. Nozzles having an inside diameter of 32 mm are preferably suitable in furnaces having a diameter of 2000 mm with particle sizes from 20 to 80 mm and high productive capacities and pressures of up to 3 bar.

Figure 2:
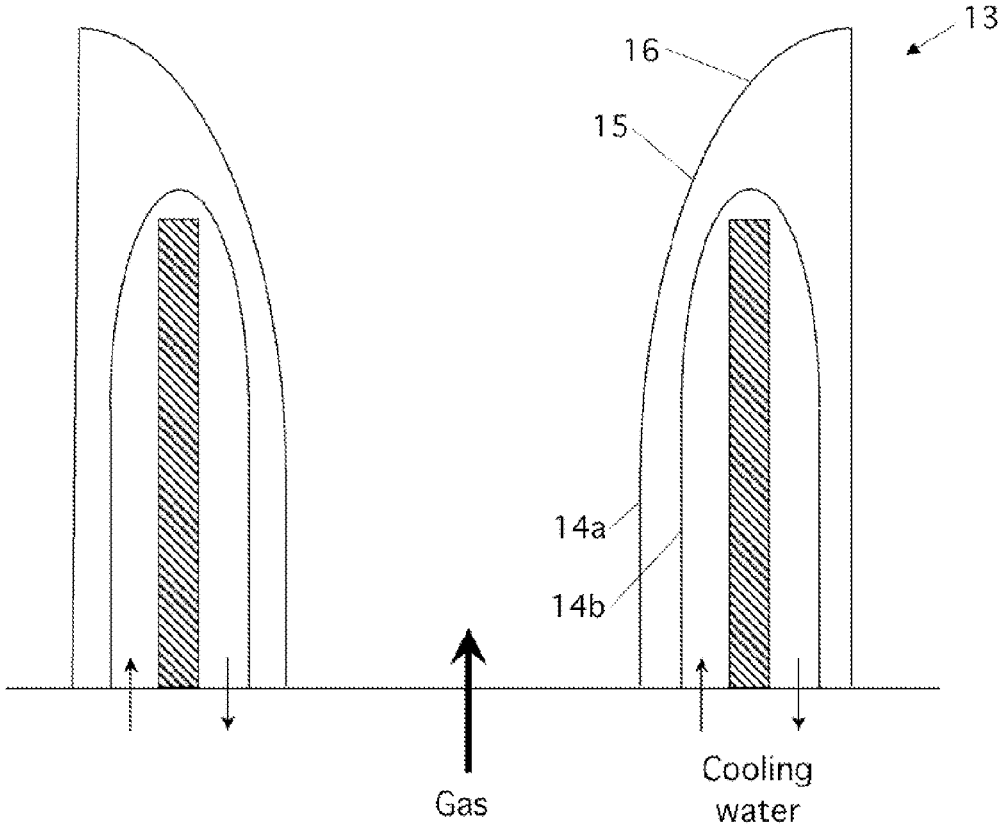
FIG. 2 shows a cross-sectional profile of a nozzle for use with the generator of FIG. 1.

For the optimum formation of the combustion zone, the radius of curvature of the nozzle opening, which widens in a manner which might be described as trumpet-like, at the gas outlet point of the nozzles is decisive. The nozzle 13 is shown in FIG. 2 having the aforementioned double-walled construction 14*a*, 14*b* and trumpet-like nozzle opening 15. The double-walled construction permits water cooling of the nozzle 13. The shape of the curve of this the widening is characterised by a radius of curvature of the surface 16 of the cylindrical portion of the nozzle 13 which continuously becomes smaller to the outlet opening of the nozzle 13, that is to say in the direction of flow of the gasification mixture. The radius of curvature is smallest at that point. The radius of curvature measured there is used hereinbelow to characterise the nozzle openings and is referred to as "the radius of curvature of the outlet opening". For example, for furnaces having a diameter of 800 mm or for particle sizes of from 10 to 40 mm, a radius of curvature of the outlet opening of 15 mm is required to form an optimum combustion zone, without bypassing at the edges, for the maximum capacity and a high gas quality, without impurities. Nozzles having a radius of curvature of the outlet opening of 35 mm are suitable especially for furnaces having a diameter of 2000 mm or for particle sizes up to 80 mm with high productive capacities of up to 1400 $Nm^3/h$.

In contrast to other processes of the prior art, the reaction in the combustion zone is controlled by injecting $CO_2$ and $O_2$ into the furnace together through the above-described nozzle, in which pre-mixing takes place in the feed line in such a manner that, viewed in the direction of flow, first $CO_2$ is introduced and only then is $O_2$ introduced into the same pipe, so that the latter is diluted by the stream of $CO_2$ gas. Adequate mixing of the gases is achieved by means of suitable mixing devices, such as, for example, two round bars, offset by 90°, in the following pipe section before the nozzle. In this manner, the two reactions that take place in the tubular shaft furnace $$C+O_2 \leftrightarrows CO_2 -94.2 \text{ kcal/mol.} \quad \text{(Eq. 1)}$$

$$CO_2+C \leftrightarrows 2\,CO +38.6 \text{ kcal/mol.} \quad \text{(Eq. 2)}$$

are concentrated in a single controllable combustion zone and are not separate and distributed over several zones in the apparatus, as described in U.S. Pat. No. 3,635,672. This concentration of the reaction sequence in a single combustion zone makes the monitoring of process parameters considerably more simple and reliable. By varying the ratio of $CO_2$ to $O_2$ in the gas mixture that is fed in, according to the type of fuel and the properties of the fuel, the reaction temperature can be controlled. The position of the Boudouard equilibrium (see Eq. 2) is affected thereby, and accordingly also the degree of purity of the CO gas.

The desired reaction temperature in the combustion zone should be greater than 900° C. if possible, so that the Boudouard equilibrium (Eq. 2) is displaced as far as possible in favour of CO formation. Increasing the amount of $CO_2$ acts in the same direction but reduces the furnace temperature again owing to the endothermic reaction of $CO_2$ with C (Eq. 2). A sufficiently high oxygen supply is therefore necessary in order to keep the furnace temperature sufficiently high by means of the exothermic oxidation reaction (Eq. 1).

Characteristic amounts of starting materials for the production of 750 kg (600 $Nm^3$) of CO gas in a cylindrical tubular shaft furnace which widens conically to the bottom and has a height of 2.30 m and a diameter of 0.80 m are: 300 kg of coke/h, 265 kg of $O_2$/h (190 $Nm^3$/h) and 215 kg of $CO_2$/h (110 $Nm^3$/h). Coke is used in a slight excess (about 10%) in order to take account of the losses of carbon and ash through flue ash. The mentioned amounts may vary within certain limits according to the type of furnace and the coke used. For the production of 1400 kg (1120 $Nm^3$) of CO gas/h, the following amounts are used per hour in a cylindrical container having a diameter of 2.0 m and a height of 5.0 m: 550 kg of coke, 510 kg of $CO_2$ (360 $Nm^3$) and 400 kg of $CO_2$ (203 $Nm^3$). In the case of types of coke which tend to be more finely grained, the amount of $O_2$ is to be reduced, and in the case of more coarse-grained types of coke, it is to be increased.

When the CO gas produced in the generator according to the invention leaves the tubular shaft furnace, it contains dust, the so-called flue ash. This is solid, dust-like ash portions which are discharged from the furnace with the CO gas stream together with carbon that has nht been burned, so that there is no build-up of ash in the furnace and accordingly no impairment of the operation of the furnace. The so-called run, that is to say the uninterrupted operating time of a furnace, in the process according to the invention may thus be several months and accordingly makes a decisive contribution to the utilisation of the capacity of the installation and to the low outlay in terms of maintenance of such an installation.

The flue ash is a mixture of substances such as, for example, inorganic constituents of the mentioned fuels, which are present after the gasification predominantly in the form of the metal oxides, optionally metal halides, and on the other hand it is fine fuel particles which have formed in the combustion zone owing to the decomposition of the fuel during the gasification operation and escape from the combustion zone so rapidly, owing to the high gas speed in the furnace, that they participate in the reaction only incompletely and are drawn off with the gas stream.

This flue ash can contain up to 80 wt. %, preferably up to 60 wt. %, carbon and represents a safety risk in the further use of the CO gas because the functioning of downstream parts of the installation is impaired considerably by deposits of these particles therein. It is therefore important to separate such flue ash particles from the CO gas as quantitatively as possible, directly downstream of the tubular shaft furnace if possible, in order to avoid unnecessarily long paths for the dust-containing gas (and accordingly deposits). For this reason, the furnace (II) is followed by a dry dust-removing device (IV), upstream of which there is arranged a cyclone dust collector for separating coarser particles from the emergent CO gas stream and returning them to the furnace. This cyclone dust collector is located in the CO gas outlet pipe in the upper part of the furnace.

The removal of dust from gases, especially also from hot gases, is known (literature: CIT; VDI; Lüger, Lexikon der Technik, Hüttentechnik, Vol. 5 (1970). Common techniques use, for example, fibrous filters or sintered filters, or dust washes, such as, for example, water washes with the aid of so-called disintegrators (Theissen). Such water washes have the disadvantage, however, that the dust is separated off only incompletely, so that subsequent cleaning using other techniques is necessary, such as, for example, fine dust removal in an electrostatic field. A further disadvantage of these water washes is the occurrence of waste water charged with dust, which must be then cleaned in an expensive operation, for example by concentration in so-called settling vessels with subsequent precipitation or filtration. Disposal of the resulting filter cakes, which contain carbon and are moist with water, is expensive from the point of view of today's environmental considerations.

So-called dry dust removal is often limited because the filter media cannot be subjected to heat or pressure, and because of the demands made in terms of the degree of dust removal or the demands made in terms of fine dust removal. Further important aspects of dry dust removal are the ability of the filter media to be re-used or regenerated, and the recovery of the filter dust for separate disposal or further use. Fibrous filters in particular can in most cases only be disposed of together with the dust, and many sintered filters tend to become blocked easily or can scarcely be regenerated.

It was therefore necessary to remove the flue ash from the CO gas as quantitatively as possible by means of suitable dry dust removal, in order to be able to utilise it separately. For energy reasons, the dust removal should take place at the outlet temperature of the CO gas from the furnace and the correspondingly high pressure, in order to avoid the unnecessary supply of further energy in a subsequent process step at high temperature.

There has been no lack of attempts to develop suitable porous sintered materials which withstand temperatures of over 400° C., do not tend to become blocked at high pressures and withstand a high number of regeneration cycles without losses in gas permeability and filtering quality. Ceramics filter cartridges, which are manufactured from ceramics-coated glass fabric of the Microtemp TM4 type (commercial name), are damaged by acidic gases and residual water in the CO gas, for example, and the pores of the glass fabric close up, so that such filters become unusable after a short time.

Surprisingly, it has now been found that sintered metal filters of chrome-nickel steel (X404 metal) and a sintered material, having a filter fineness of 0.5 μm, are best suited to the demands mentioned above.

The cleaning or regeneration of such sintered filters is carried out at intervals by pressurised pulses of CO gas, which is removed from the purified gas side. There are preferably used as the sintered media stainless steel ANSI 316L, 1.4404 with a filter fineness of <500 μm, preferably <10 μm, particularly preferably 0.5 μm. The filter cartridges are arranged in rows, and the gas flows through them from the outside inwards. Cleaning can be carried out, per cartridge row, according to a time control, an admissible pressure limit on flowing through the filter cake, or a combination of low pressure and cleaning pulse. To that end, purified recycled gas under a pressure of 10 bar (about 1 $m^3$ per filter row) is passed through the filter cartridges from the inside outwards in a pulse of 400 ms. The cleaning operation of the filter is not interrupted thereby. Each row of filter cartridges can be cleaned at a timed interval or in succession.

In a preferred form, the dry dust-removing device (IV) consists of a jacket-heated cylindrical container having a conical dust outlet for an excess pressure of 6 bar and an operating temperature of 400° C. The diameter is about 1200 mm and the height about 4700 mm. In the container, 46 filter cartridges are set into a filter plate in 5 rows. The number and arrangement of the filter cartridges, and the dimensions of the container, can vary. The gas flows through the sintered metal filter cartridges, which have a diameter of 80 mm and a total filter area of 24 $m^2$, from the outside inwards with a flow rate of 100 m/h. >99%, preferably >99.9%, of the dust is separated off thereby. Cleaning of the filter cartridges is carried out according to a time or pressure interval for each row of filter cartridges using purified CO gas at a pressure of 10 bar, from the inside outwards.

Although chrome sintered metal filter cartridges are wholly suitable for removing the dust from hot CO gas, they are very expensive, so that inexpensive alternatives have been sought. Surprisingly, it has now been found that adequate electrostatic dust separation is also possible using newly developed pressure-resistant hot gas electro-gas cleaners (EGR). The technique known hitherto uses electrostatic separators which are designed either for high temperatures or for high pressures. New in this development was the combination of high pressures and high temperatures in a newly constructed and developed EGR. Cleaning at high temperatures and pressures in particular is a new development, because the scaling technique used hitherto had to be replaced. The passage and sealing of the high-voltage connections was also newly developed. The result was a pressurised container with pressure- and high-temperature-resistant cleaning (including the lock system) and high-voltage implementation.

The dust-free CO gas still contains inorganic and organic sulfur compounds, which may be troublesome in further use, for example for the preparation of phosgene. The CO gas so produced may therefore optionally be passed directly into a subsequent desulfurisation device (V), as is described in DE-A 10 301 434, for example.

FIG. 1 shows a possible embodiment of the generator according to the invention by way of example and in diagrammatic form.

The combustion material is introduced at (1) into the locks (2) and (3) of the double-chamber lock and is passed from there into the tubular shaft furnace (4). Cooling water is fed through (5) to the tubular shaft furnace and the inlet nozzle and is conveyed away again through (9). Oxygen (6) and carbon dioxide (7) are introduced as the gasification mixture through the inlet nozzle.

After passing through a cyclone dust collector (9), the emergent CO gas stream is freed of coke dust in a dry dust-removing device (10) and is drawn off through (11). The coke dust that has been separated off is removed at (12).

The present invention also provides a process for the production of carbon-monoxide-containing gas by reaction of a carbon-containing combustion material in a tubular shaft furnace according to the invention, as has been described above.

Suitable carbon-containing raw materials are any known raw materials that contain more than 85 wt. %, preferably more than 95 wt. %, carbon and meet particular purity demands regarding the formation of undesirable secondary products.

A further factor that affects the combustion zone in terms of process technology is the nature and properties of the fuel. This means inter alia the particle size distribution of the fuel, its residual ash content, and also the residual ash composition. By making the correct choice, the formation of a liquid ash melt or of an iron melt, which may impair the functioning of the nozzle and necessitate the shutting down of the furnace, is avoided. A reduction in the capacity of the installation is associated therewith. In the tubular shaft furnace used according to the invention it is scarcely possible to utilise very fine-grained fuels, such as, for example, coke dusts, under economically viable conditions; this would require a change in the fuel supply technology, which was not an object of this invention. It likewise makes no sense economically, although it is technically possible, to process very coarse-grained combustion material (greater than 100 mm) in such furnaces, especially in tubular shaft furnaces of small diameter (0.8 m).

Surprisingly, it has now been found that fuels having a particle diameter from 20 to 90 mm, preferably from 30 to 80 mm and particularly preferably from 40 to 60 mm, exhibit optimum combustion behaviour. The proportion by weight of fines in the fuel having a particle size less than 10 mm should not exceed 5 wt. % of the amount of fuel, in order to avoid problems when conveying the product and in the combustion process. This can be ensured by suitably screening the fuel before the operation of charging the double-chamber locks.

For problem-free combustion behaviour in the tubular shaft furnace described herein, the fuel must also meet particular demands in respect of the content of inorganic residues and of volatile constituents. This is concerned especially with avoiding the accumulation of liquid slag on the base of the furnace or avoiding the deposition of ash in the entire combustion chamber of the furnace in the event that the ash content is too high or the ash composition from the fuel is unsuitable. Such phenomena might considerably impair the so-called run of a furnace owing to the required maintenance intervals and lessen the capacity of the installation accordingly.

Surprisingly, it has now been found that these mentioned problems can be avoided if the ash content of the fuel does not exceed 5 wt. %, preferably is less than 2 wt. %, particularly preferably less than 1 wt. %, and if the iron content in the fuel is not greater than 5000 ppm, preferably less than 500 ppm, particularly preferably less than 100 ppm.

Furthermore, the nickel content is especially less than 1500 ppm, preferably less than 500 ppm, particularly preferably less than 250 ppm, and the Ca content is less than 2500 ppm, preferably less than 1000 ppm, particularly preferably less than 250 ppm.

Surprisingly, it has also been found that a CO gas having the desired quality properties can be produced if the fuels used contain less than 10 wt. %, preferably less than 5 wt. %, water adhering to the surface (determined according to DIN 51718), if the content of volatile hydrocarbons is less than 0.8 wt. %, preferably less than 0.6 wt. % (determined according to DIN 51720) and if the sulfur content is less than 2.5 wt. % (preferably <1.5 wt. %, particularly preferably <1.0 wt. %).

Volatile constituents in the fuel can likewise cause problems if they are relatively large amounts of hydrocarbons or water. Under the reaction conditions in the combustion zone, hydrocarbons form methane and hydrogen; hydrogen is also formed from water that passes into the combustion zone. Methane and hydrogen are tolerable as secondary products in the CO gas only within certain limits, because these products would be chlorinated when the CO gas is used to produce phosgene. The formation of HCl is to be avoided for reasons of corrosion, and the formation of carbon tetrachloride for reasons of toxicity.

Suitable fuels which meet the above-mentioned demands and which can be reacted successfully in terms of technology and economy to CO gas in the process described herein are, for example, coke types, such as, for example, calcined pitch coke, calcined petroleum coke, lignite coke, coal coke, and graphite, or calcined shaped bodies of graphite and/or coke and/or pitch as binder.

Examples of such shaped bodies are, for example, graphite electrodes or anodes from the production of aluminium, which are obtained in used form as residues and, after comminution to the appropriate particle size, can expediently be utilised. The mentioned fuels can be used alone or in admixture with one another.

Preference is given to low-ash coke types, especially low-ash pitch coke or low-ash broken anode materials.

The CO gas produced according to the invention can optionally be additionally purified (e.g. desulfurised) and used for chemical syntheses; especially in the preparation of phosgene from carbon monoxide and chlorine.

The process is of interest especially for production sites which have no use for secondary products, such as, for example, hydrogen, which are necessarily formed in the reformer processes by which CO gas is likewise produced.

EXAMPLE OF THE PRODUCTION OF CO GAS ACCORDING TO THE INVENTION

The following information is intended to explain the invention without limiting it to the information given by way of example:

CO gas is produced by the above-described process according to the invention in an installation (generator) which consists of the following installation parts described according to the invention: tubular shaft furnace, nozzle for feeding the $O_2$ and $CO_2$ gas mixture into the combustion chamber, double-chamber lock system for charging the furnace with coke, and a hot gas filter for the dry removal of dust from the emergent CO gas.

The cylindrical tubular shaft furnace, having a diameter of 2.00 m and a height of 5.00 m, has a water-cooled double jacket of steel operated without pressure and permits internal pressures up to 6 bar.

The double-chamber lock system for charging the furnace with the types of coke described according to the invention consists of tapered locks which have an angle of inclination of 40° and a diameter of 1.20 m at the widest point. The locks, which each have a container volume of 920 litres, are lined on the inside with special ceramics (Kalocer), and the lock adjacent to the furnace is closed off by a pneumatically operated sealing cone of high-temperature steel with metal sealing elements, as the valve, and is automatically flushed with inert gas after each addition of coke. The two locks are connected one beneath the other by means of a ball valve with stellite-coated seals (Tyko). The lock valve on the charging side (surrounding air) is a Strack slide valve with a sintered metal seal.

The water-cooled copper nozzle for feeding $O_2$ and $CO_2$ into the combustion chamber of the tubular shaft furnace has an inside diameter of 32 mm and a radius of the outlet opening of 35 mm and permits the production of 1400 kg of CO gas at pressures up to 3 bar.

The hot gas filter is a jacket-heated cylindrical container having a diameter of 1.20 m and a height of 4.70 m, which is suitable for an operating temperature of 400° C. and an excess pressure of 6 bar and which has a conical dust outlet. In this container, 46 filter cartridges made of a sintered metal (ANSI 316 L, 1.4404), having a filter fineness of <10 μm and a filter area of 24 $m^2$, are set into a filter plate. The dust-laden CO gas flows onto the filter cartridges from the outside at a speed of about 100 m/h and flows, in cleaned form, inwards, while >99%, preferably >99.9%, of the dust is separated off at the filter surface.

The production of CO gas in the apparatus described above is carried out as follows: in a tubular shaft furnace which has already been charged and is at reaction temperature, a gas mixture consisting of 510 kg (360 $Nm^3$) of oxygen and 400 kg (200 $Nm^3$) of carbon dioxide per hour is introduced into the combustion zone of the furnace, at an excess pressure of 3 bar, via the water-cooled copper nozzle. 1400 kg (1120 $Nm^3$) of CO gas are produced per hour, the CO gas being freed of dust in the hot gas filter under a pressure of about 3 bar and at a furnace outlet temperature of 350° C. When the level of coke in the furnace falls below a critical level, coke is fed into the furnace in portions via the lock system, in an amount of 550 kg per hour. This is slightly more (about 7 wt. %) than the stoichiometric amount of carbon, because ash portions and losses of carbon with the flue ash are to be taken into account. The coke used has a sulfur content of 0.5 wt. %, an ash content of 1.0 wt. %, a metal content of 250 ppm Fe, 200 ppm Ni and 300 ppm Ca, a residual water content of 5 wt. % and a content of volatile constituents of 0.5 wt. %. In the subsequent hot gas filter, more than 99.9% of the flue ash is retained; cleaning of the filter cartridges takes place at regular intervals by pressurised pulses of purified CO gas.

The CO gas leaving this installation has a content of 98 vol. % CO gas. Further constituents are: 3500 mg/$Nm^3$ of organic sulfur compounds; 200 mg of inorganic sulfur compounds; 0.8 vol. % hydrogen; 0.1 vol. % oxygen; 30 ppm of methane. The remainder to 100 vol. % is inert gases, such as $CO_2$ and $N_2$.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A generator comprising (I) a double-chamber lock comprising two tapered or vertical chambers lined with ceramics or plastics, as a charging device, (II) at least one tubular shaft furnace comprising a water-cooled double jacket of steel, (III) a double-walled, water-cooled inlet nozzle of pure copper for a gasification mixture, arranged centrally in the tubular shaft furnace just above the base, and (IV) a dry dust-removing device, wherein the double-chamber lock (I) is adapted to open one of the chambers when the lower chamber of the double-chamber lock (I) is flushed with inert gas after each charging operation and opening operation, and the inlet nozzle (III) is configured as a mixing member for the constituents of the gasification mixture, the inlet nozzle is curved in a direction of flow of the gasification mixture and is characterised by a radius of curvature of the surface of the cylindrical portion of the nozzle which continuously becomes smaller to the outlet opening, and the direction of flow of the gases leaving the inlet nozzle is directed vertically upwards.

2. The generator according to claim 1, wherein additions of fuel into the tubular shaft furnace are triggered by a radiometric level-measuring device attached to the outside wall of the tubular shaft furnace.

3. The generator according to claim 1, wherein the chambers of the double-chamber lock have on the valves a mechanism which has the effect that, on opening of the valves, the sealing surfaces are raised from the seals and the valves are opened without contact with the sealing elements.

4. The generator according to claim 1, wherein the inlet nozzle has an inside diameter in the cylindrical portion of from 18 to 32 mm.

5. The generator according to claim 1, wherein, in the upper portion, the inlet nozzle has a radius of curvature at the outlet opening of the nozzle of from 15 mm to 35 mm as the production amount increases.

6. The generator according to claim 1, wherein the inlet nozzle is manufactured from pure oxygen-free copper.

7. The generator according to claim 1, wherein the tubular shaft furnace (II) is a cylindrical container or a cylindrical container which widens conically to the bottom.

8. The generator according to claim 1, wherein the dry dust removal is carried out at elevated temperature and elevated pressure on sintered metal filters of chrome-nickel steel or on electro-gas cleaners, which are cleaned periodically during continuous operation.

9. The generator according to claim 1, wherein a plurality of tubular shaft furnaces of the same type are connected to form a production unit, the individual tubular shaft furnaces being separated from one another by valves in the form of backflow preventers in the pipe system.

10. The generator according to claim 1, wherein the chambers of the double-chamber lock have on the valves a mechanism which has the effect that, on opening of the valves, the sealing surfaces are raised from the seals and the valves are opened without contact with the sealing elements.

11. The generator according to claim 1, wherein the inlet nozzle has an inside diameter in the cylindrical portion of from 18 to 32 mm.

12. The generator according to claim 1, wherein, in the upper portion, the inlet nozzle has a radius of curvature at the outlet opening of the nozzle of from 15 mm to 35 mm as the production amount increases.

13. The generator according to claim 1 wherein the inlet nozzle is manufactured from pure oxygen-free copper.

14. The generator according to claim 1, wherein the tubular shaft furnace (II) is a cylindrical container or a cylindrical container which widens conically to the bottom.

15. The generator according to claim 1 wherein the dry dust removal is carried out at elevated temperature and elevated pressure on sintered metal filters of chrome-nickel steel or on electro-gas cleaners, which are cleaned periodically during continuous operation.

16. The generator according to claim 1, wherein a plurality of tubular shaft furnaces of the same type are connected to form a production unit, it being possible for the individual tubular shaft furnaces to be separated from one another by valves in the form of backflow preventers in the pipe system.

17. The generator according to claim 1, further comprising a desulfurising device.

* * * * *